United States Patent [19]

Baumberg

[11] Patent Number: 4,519,749

[45] Date of Patent: May 28, 1985

[54] WIND-SOLAR LIFT PUMP

[75] Inventor: Iosif Baumberg, Brooklyn, N.Y.

[73] Assignee: B & H Technologies, Inc., New York, N.Y.

[21] Appl. No.: 441,740

[22] Filed: Nov. 15, 1982

[51] Int. Cl.[3] ..... F04F 9/00

[52] U.S. Cl. ..... 417/158; 417/379

[58] Field of Search ..... 417/207–209, 417/379, 55, 158, 197; 60/398

[56] References Cited

U.S. PATENT DOCUMENTS

| | | | |
|---|---|---|---|
| 116,025 | 6/1871 | Clow et al. | 417/379 |
| 776,106 | 11/1904 | Beurrier | 417/379 X |
| 2,608,160 | 8/1952 | Moody | 417/197 |
| 2,755,745 | 7/1956 | Lewis | 417/379 |
| 3,972,651 | 8/1976 | Fletcher et al. | 417/379 X |
| 4,177,020 | 12/1979 | Chadwick | 417/379 |

FOREIGN PATENT DOCUMENTS

| | | | |
|---|---|---|---|
| 2357762 | 10/1978 | France | 417/379 |
| 566956 | 8/1977 | U.S.S.R. | 417/379 |

*Primary Examiner*—Edward K. Look

*Attorney, Agent, or Firm*—David M. Warren; Martey R. Perman; Clarence A. Green

[57] ABSTRACT

A device for the lifting of liquid solely by the use of solar energy is constructed of two vertically disposed pipes, one pipe extending below the surface of the liquid and the second pipe extending above the surface of the liquid. A third pipe, in the form of a transverse section, joins the top of the first pipe and the bottom of the second pipe, the transverse section being inclined to provide entrapment of liquid therein upon submergency of the first pipe. A liquid inlet is provided at the bottom of the first pipe and an air vent is provided at the top of the first pipe at the junction thereof with the transverse section. A discharge port for liquid is provided at the top of the second pipe. An air pressure differential is established between the vent and the discharge port for forcing liquid from the transverse section to the port. The pressure differential is established by use of a container of air coupled to the vent, which container becomes heated upon exposure to the sun, or by an air foil in the form of a venturi connected adjacent the discharge port, or by a combination of the container with a wind intercepting funnel. The inlet includes a constriction to slow the rate of liquid entry into the first pipe to permit air pressure equilibrium to be re-established through the transverse section prior to the refilling thereof with liquid.

8 Claims, 13 Drawing Figures

WIND-SOLAR LIFT PUMP

BACKGROUND OF THE INVENTION

This invention relates to the transformation of solar energy and wind energy to mechanical energy and, more particularly, to a device for the raising of liquids by the use of solar and wind energies.

In the construction of devices for the raising of liquid, such as the drawing of water from a well, it is desirable to avoid undue mechanical complexity as well as to avoid the unnecessary use of fossil fuels. Typically, water is drawn from a well by the use of a pump including a moving piston, valving, and an electric or gasoline driven motor for driving the piston. Thus, the typical liquid lifting device is characterized by a variety of moving parts as well as a drive unit which either, employs the fossil fuels such as gasoline directly, or utilizes the electric power which, in both cases, necessitates the burning of petroleum or coal. The foregoing characteristics of the typical pumping system are disadvantageous because of the necessity for the fossil fuel consumption and for the requirement of mechanical complexity. The foregoing disadvantages become more severe when the liquid lifting device is to be operated at a remote site, such as in the desert, as might be the case for an irrigation project. At such remote sites, the foregoing disadvantages are exacerbated by the necessity to transport the fuel a long distance or, to construct electric power transmission lines for a long distance.

Thus, it is an important object of the invention to reduce the mechanical complexity of a liquid lifting device, particularly, by reducing the number of moving parts, and also to reduce dependency of the drive upon fossil fuel consumption.

SUMMARY OF THE INVENTION

The foregoing disadvantages are overcome and the foregoing objectives are met by a liquid lifting device which, in accordance with the invention, directly utilizes the heat of solar energy in a first embodiment of the invention, and directly utilizes the power of the wind in a second embodiment of the invention for accomplishing the lifting of liquids, particularly, the raising of water from a well or other repository of the water. In both embodiments of the invention, the invention comprises a lower vertical pipe extending from the surface of the water to a point below the water surface, and an upper vertical pipe extending from the surface of the water to a point above the surface of the water. The top of the lower pipe is joined to the bottom of the upper pipe by an inclined transverse section of pipe. All of the pipes are of cylindrical form, each of the pipes having, preferably, a circular cross-section.

With respect to the transverse section of pipe, the inclination thereof provides a high end and a low end, the high end being joined to the top of the lower pipe at a point slightly above the surface of the water, while the low end of the transverse section is connected to the bottom of the upper pipe at a point slightly below the surface of the water. More particularly, the difference in height between the high end and the low end provides that, with respect to the interior surface thereof, the lowest part of the interior surface, at the high end, is higher than the highest part of the interior surface at the low end. In the joining of the transverse section of pipe to the upper pipe and the lower pipe, a bend is preferably formed in the end portions of the transverse section so as to provide an overall curvature, in the form of a reverse or S curve, in a configuration similar to that often referred to as a trap.

The top of the upper pipe is bent over in an end fitting to facilitate the discharge of liquid drawn upwardly through the pipe. The high end of the transverse section is provided with a vent to air. The bottom of the lower pipe is provided with an inlet port having a constriction therein for metering water, or other liquid, into the lower pipe.

In the case of the drawing of water from a well or pond, the water is seen to rise through the lower pipe until equilibrium with atmospheric pressure is attained. With respect to the interior surface of the transverse section, the low portion of the high end is depressed slightly below the surface of the water so that, upon the attainment of the foregoing equilibrium with the atmospheric pressure, the height of the water in the lower pipe is sufficient to pour over through the junction with the transverse section so as to flood the lower portion of the transverse section. The force for lifting the water from the transverse section through the upper pipe to its outlet port is formed by establishing a pressure differential between the air inlet at the high end of the transverse section and the outlet port of the upper pipe.

In accordance with one embodiment of the invention, the pressure differential is established by coupling a closed air chamber to the air inlet, the air chamber being coated with a substance with absorbs heat rays from the sun. Upon absorbing heat from the sun, the entrapped air expands to drive water out of the transverse section in both directions through both the upper and lower pipes. Movement through the lower pipe stops when the pressure differential corresponds to a reduction in height of the column of water in the lower pipe. In the upper pipe, the column of water is approximately equal in length to a portion of the water held in the low end of the transverse section, the length and weight of the column of water in the upper pipe remaining constant as it rises through the upper pipe under the force of the expanding gas from the heated air chamber. Upon discharge of the water from the upper pipe, the remaining air in the air chamber undergoes an adiabatic expansion to reach equilibrium pressures with the atmosphere throughout the system of pipes. During the time in which the equilibrium is being reached, water is admitted through the inlet port at a sufficiently slow rate so as to provide adequate time for the foregoing reaching of equilibrium, after which the water rises in the lower pipe until equilibrium is reached between the weight of the water in the lower pipe and the atmospheric pressure.

In the second embodiment of the invention, the lifting force is obtained from a wind passing through an air foil affixed adjacent the outlet port of the upper pipe. The air inlet at the high end of the transverse section is vented directly to the atmosphere. Thereby, upon the introduction of suction at the top of the upper pipe, the water entrapped in the transverse section is drawn away from the air inlet to proceed upwardly through the upper pipe to the outlet port. Thereafter, additional water advances through the liquid inlet at the bottom of the lower pipe to refil the transverse section. Thereby, in accordance with the operation of the invention, water or other liquid has been raised by direct utilization of the thermal energy of the sun or, alternatively, directly by the use of wind. In both cases, the invention provides for the raising of the water without the use of any moving mechanical parts in the system of pipes.

In yet a third embodiment of the invention, features of the preceding two embodiments are combined for lifting by use of both wind and solar energy.

BRIEF DESCRIPTION OF THE DRAWINGS

The foregoing aspects and other features of the invention are explained in the following description, taken in connection with the accompanying drawings, wherein.

DETAILED DESCRIPTION

Figures 1A, 1B, 1C, 1D, 1E:
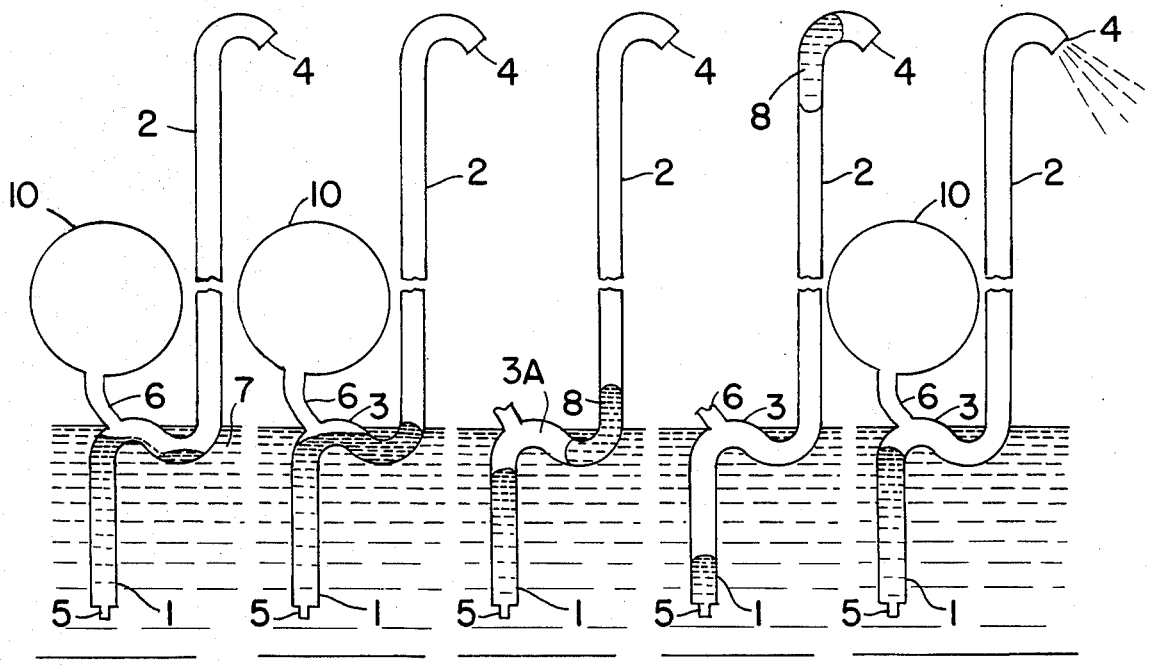
FIGS. 1A–1E each show the same pipe system of the invention, the individual figures also showing successive stages in the progression of liquid from the initial position to the discharge position under a driving force provided by a closed container of heated air.

Referring now to the figures, the piping system of the invention for the raising of liquid is readily fabricated as a single cylindrical pipe which is provided with a bend in the form of a reverse curve or S curve. In its resulting configuration, the piping system comprises a lower pipe 1 and an upper pipe 2 which are positioned with a generally vertical orientation. The lower pipe 1 and the upper pipe 2 are joined together by a transverse section 3 of pipe, the transverse section being inclined relative to the horizontal so that the high end of the section 3 connects with the top of the lower pipe 1 while the low end of the section 3 connects with the bottom of the upper pipe 2. A discharge port 4 is located at the top of the upper pipe 2, and is curved for facilitating the discharge of the water into a container (not shown) or other device for receiving the liquid. A liquid inlet 5 is located at the bottom of the lower pipe 1 and an air-inlet vent 6 is located at the top of the junction of the lower pipe 1 and the transverse section 3.

The lower pipe 1 and the transverse section 3 is immersed in a liquid 7, such as water, while the upper pipe 2 extends upwardly from the surface of the liquid 7. In FIGS. 1C and 1D there is shown an exemplary bead 8 of liquid rising through the upper pipe 2. With respect to the interior surface of the section 3, the lowest part of the interior surface at the high end of the section 3 is higher than the highest part of the interior surface at the low end of the section 3. Also, the lowest part of the interior surface at the high end of the section 3 is lower than the surface of the liquid 7. Thereby, in the absence of any pressure differential in the air pressure at the vent 6 and the port 4, the liquid rises in the lower pipe 1 and flows over the junction of the pipe 1 and the section 3 to fill the section 3 with the liquid 7.

The embodiments represented by the FIGS. 1A–1E and 2A–2E differ in that an airfoil 9 is positioned adjacent the port 4 in FIGS. 2A–2E while a container 10 of heated air is attached to the vent 6 in FIGS. 1A–1E for providing a pressure differential between the vent 6 and the port 4 for driving the bead 8 upwardly through the upper pipe 2.

With reference to FIGS. 1A–1E, the operation of the system of the invention is now explained for implementation of the driving force obtained by the use of the container 10. The container 10 is coated with a heat absorbent material, such as black paint, or other non-reflective coating which may be of a suitable plastic or rubber material whereby the thermal radiation of the sun is absorbed into the container 10 for heating the contents thereof.

The technology of "aerolift" devices may be seen in the following U.S. Pat. Nos. 532,699, 556,436, 566,987, 580,540, 597,023, 1,154,745, 1,343,693, 1,741,571, 1,811,295, and 2,461,032.

In operation, the pipe system is submerged in the liquid 7 to allow the liquid 7 to be metered into the lower pipe 1 via the inlet 5 so as to flow upwardly through the pipe 1 and over the top of the bend at the junction of the pipe 1 and the section 3 so as to fill the section 3 with the liquid 7. The filling of the section 3 is shown in FIG. 1A for the embodiment utilizing the container 10 for generating the air-pressure differential. The section 3 continues to fill until the air communication therethrough is terminated by the rising liquid as shown in FIG. 1B. At this point in time, the pressure of the heated air in the container 10 begins to build up as the air is further heated by the rays of the sun impinging upon the outer surface of the container 10. As the air is heated, the pressure therein increases to force the liquid away from the vent 6. As the expansion of the heated air continues further, the liquid 7 is driven further away from the vent 6 to form an air gap 3A as shown in FIG. 1C. At this point in time, the bead 8 of liquid becomes defined, and begins to travel along the upper pipe 2 away from the vent 6 and towards the discharge port 4. In FIG. 1D, the bead 8 has advanced to the top of the upper pipe 2 while the liquid in the lower pipe 1 has been driven downwardly towards the inlet 5. The depression in the level of the liquid in the lower pipe 1 is, as may be appreciated from an operation of hydrodynamic pressures, such that the weight of the liquid removed from the lower pipe 1 is equal to the weight of the bead 8. Finally, the liquid in the bead 8 is discharged through the port 4, as shown in FIG. 1E, whereupon air communication is resumed between the container 10 via the section 3 and the upper pipe 2.

Since the weight of the bead 8 is constant as it passes upwardly through the pipe 2, and since the cross-section area of the pipe 2 is constant, the pressure of the air in the upper pipe 2 remains constant as the air expands from the heating in the container 10. Accordingly, the air undergoes an isobaric expansion while doing work against the liquid bead 8, the energy for the work coming from the solar heating of the container 10 and the air therein. After the discharge of the liquid from the port 4, the back pressure of the weight of the bead 8 upon the entrapped air is no longer present, and accordingly, the air is free to expand by passage through the port 4. This expansion is adiabatic, in that no work is being done by the air, the adiabatic expansion resulting in a cooling of the air within the container 10. Atmospheric pressure then returns to the pipe system whereupon the liquid 7 is then permitted to re-enter the inlet 5 to rise through the lower pipe 1 to its initial level. The inlet 5 includes a constriction for restraining the flow of liquid so as to provide adequate time for the adiabatic expansion of the air and the restoration of atmospheric pressure in the pipe system. The filling of the lower pipe 1 is then completed with the entry of the liquid into the transverse section 3 (FIG. 1A) and the termination of the air communication therethrough (FIG. 1B).

The operation of the system of the invention for the alternative embodiment (FIGS. 2A–E) wherein the driving force is provided by the wind, follows the operation in an analogous manner to that described with reference to the first embodiment in FIGS. 1A–E. In particular, it is noted that insofar as the physics of the wind is understood, the energy for creation of the winds comes from the sun. Accordingly, the use of the energy of the wind in the operation of the invention is therefore a use of energy originally provided by the sun, just as the heating of the air in the container 10 is a utilization of solar energy.

Figures 2A, 2B, 2C, 2D, 2E:
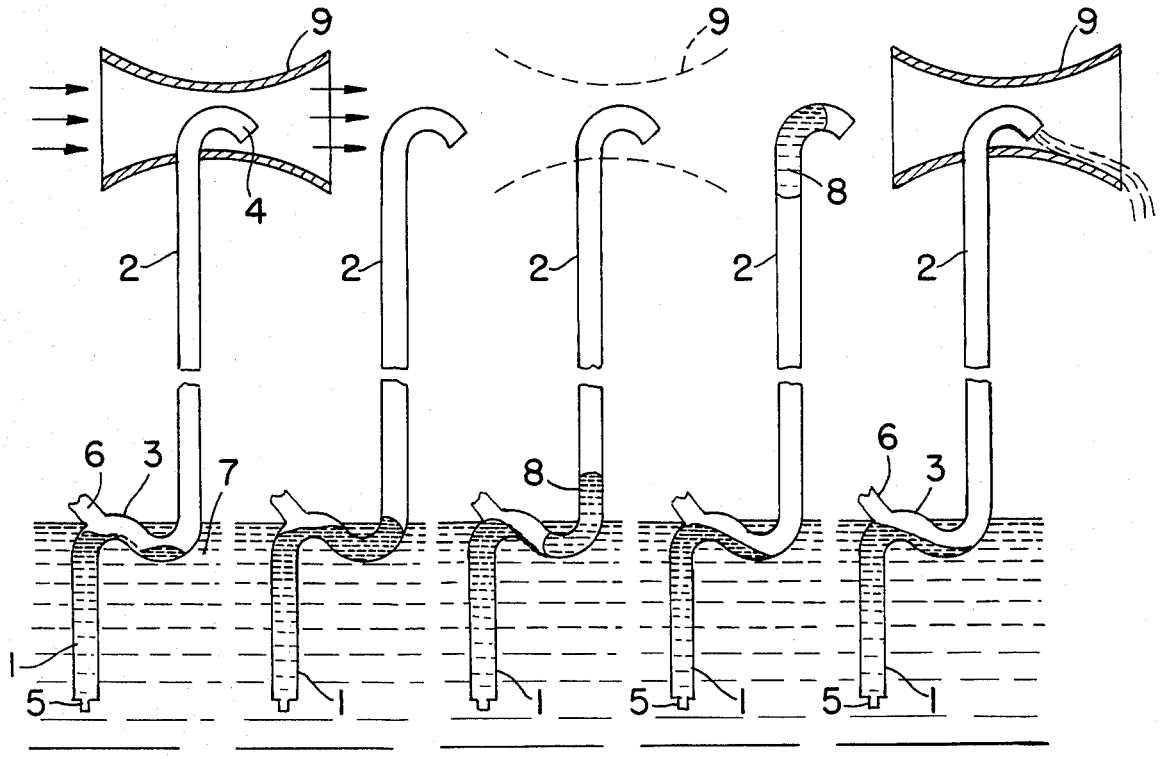
FIGS. 2A–2E show the same pipe system as disclosed in FIGS. 1A–1E, but with the driving force being provided by wind.

It is noted that the level of the liquid in the pipe 1 differs somewhat from the level described previously for the embodiment of FIGS. 1A–1E. In the embodiment of FIGS. 2A–2B, the level of the liquid in the pipe 1 remains in the vicinity of the level of the body of the liquid 7 outside the pipe 1 since the vent 6 is vented directly to the atmosphere while suction is applied by the airfoil 9 to the discharge port 4. However, the sequence of the raising and discharge of the bead 8 of liquid, followed by the refilling of the transverse section 3 is the same in both embodiments of the invention. Also, in both embodiments of the invention, during the refilling of the transverse section 3, the liquid is metered by the inlet 5 at a sufficiently slow rate to allow for the discharge of the bead 8 and the restoration of uniform air pressure through the pipe 2 and the section 3 prior to the blockage of the air passage through the section 3 by the incoming liquid.

Figure 3A:
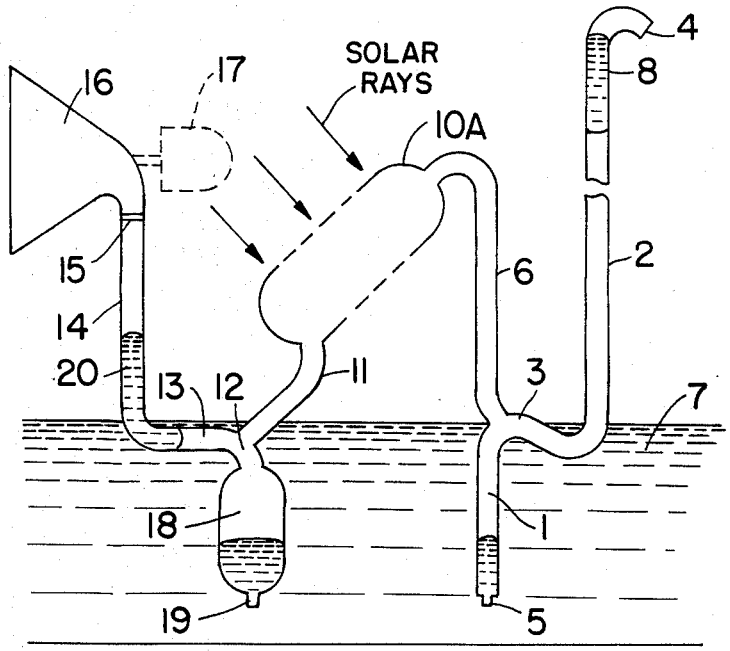
FIGS. 3A–3B show liquid levels in a combined system of the container of heated air and the wind force.
Figure 3B:
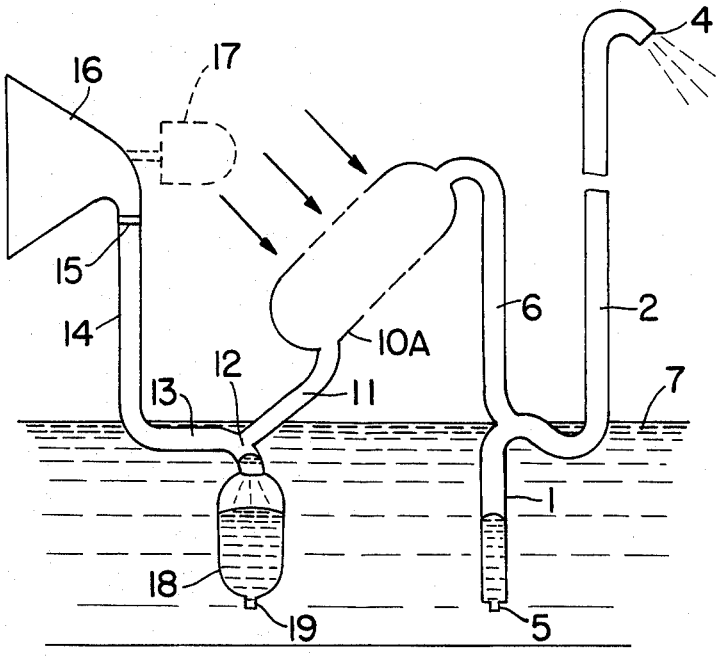

In FIGS. 3A–3B, there is shown a third embodiment of the invention combining features of the preceding two embodiments. This is accomplished by altering the air-heating container 10 to provide a container 10A having an additional port connected with a pipe 11 at an end of the container 10A, located above the surface of the liquid 7 and opposite the connection with the vent 6. Pipe 11 is coupled via a tee 12 to one end of a horizontal pipe 13, both the tee 12 and the pipe 13 lying below the surface of the liquid 7. The opposite end of pipe 13 is coupled to a vertical pipe 14 which extends above the surface of the water and connects via a rotary joint 15 to a wind-receiving funnel 16. The funnel 16 swivels about the pipe 14 via the joint 15, and may be driven to point into the wind by an optional wind vane 17 (shown in phantom) extending from the back side of the funnel 16. A submerged tank 18 has, at its bottom, an inlet port 19 with a constriction therein for the metering of the liquid 7. The tank 18 is connected, at its top, to the leg of the tee 12.

The operation begins with the filling of the pipe 1 and the tank 18 via their respective inlets 5 and 19. Subsequently, the air in the container 10A is heated by the sun with a resulting expansion of the container which forces air into both the vent 6 and the pipe 11. Liquid is then driven down the pipe 1 and up the pipe 2 as described previously in FIGS. 1A–1E.

As shown in FIG. 3A, the pressure exerted on the bottom of the bead 8 is also present in the pipe 11 with the result that liquid is driven downwardly in the tank 18 as well as upwardly in the pipe 14. The length of the horizontal pipe 13 is greater than that of the transverse section 3 and, thus, greater than the length of the bead 8. Thereby, a column 20 of liquid forming the pipes 13 and 14 rises in the vertical pipe 14 until the back pressure exerted on the expanding air by the weight of the column 20 is equal to the pressure exerted against the bead 8 of liquid rising in the pipe 2. The liquid column 20 then remains stationary as the bead 8 continues to ascend with further expansion of the air with heating of the container 10A. The levels of the liquid in the tank 18 and the pipe 1 are lowered by the exit of liquid through the inlets 19 and 5 and remain in equilibrium with the foregoing pressure.

As shown in FIG. 3B, subsequent to the discharge of the liquid bead 8 from the port 4, the air pressure then drops allowing the column 20 to fall through the pipes 14 and 13 into the tank 18. The diameter of the tank 18 is substantially larger than the diameter of the pipe 1 so as to provide sufficient volume to the tank 18 for receipt of the liquid of the column 20. The tee 12 is now empty of any liquid so that there is a free air path from the funnel 16 through the tee 12, the container 10A and the pipe 2. Thereafter, the liquid slowly enters through the constricted inlets 19 and 5 in the tank 18 and the pipe 1, respectively, until the tee 12 and the transverse section 3 are both filled with the liquid. Thus, it is seen that the tee functions as a valve with respect to the air flow, such valve being closed when liquid is present in the tee 12, the valve being open when the liquid has been voided.

The embodiment of the invention shown in FIGS. 3A–3B provides for a more efficient utilization of the energies of the sun and the wind for the lifting of liquid. Such efficiency results from the combined forces of both the wind and the heated air in the lifting of the liquid bead 8. For example, during the presence of a steady wind, the bead 8 can be lifted before the air in the container 10A fully expands due to the additional pressure developed by the force of the wind acting through the funnel 16 and downwardly upon the liquid column 20. Also, upon discharge of the liquid from the port 4, the wind force rapidly injects cool air into the container 10A to restart the heating and expansion process.

Figure 4:
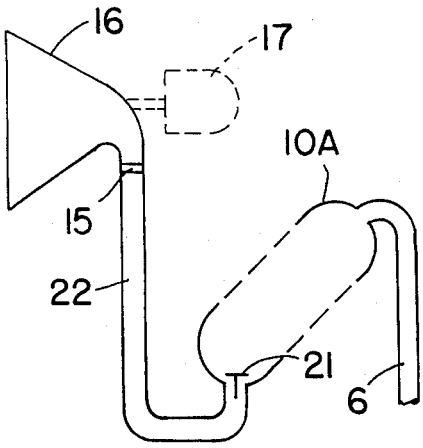
FIG. 4 is a modification of the embodiment of FIG. 3A.

In FIG. 4, there is shown a modification of the embodiment of FIG. 3A in which the valve function of the tee 12 and the tank 18 is replaced, in FIG. 4, by a check valve 21. The valve 21 is located within a valve body formed by the junction of a tube 22 with the container 10A. The tube 22 replaces the passageway formed previously by the interconnection of the pipes 11,13 and 14, and is formed, accordingly, with a horizontal portion disposed between two vertical portions, one of which terminates at the joint 15, and the other of which terminates at the junction with the container 10A.

The operation of the embodiment of FIG. 4 follows that of FIG. 3A, the openings and the closings of the valve 21 providing for the entry of air into the container 10A and the expelling of air via the vent 6. The valve 21 is of simpler construction than the tee 12 and the tank 18, and is useful in those situations wherein there is sufficient wind force to open the valve 21. Thus, the movable disk of the valve 21 floats on a moving airstream from the wind. The valve 21 is readily fabricated of a light-weight plastic disk, which serves as the closure member, and a depending stem, which serves as a positioning guide. The stem and disk may be integrally formed by standard molding processes.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A device for the raising of liquid by the use of solar and/or wind energy comprising:

a first section of pipe to be immersed in the liquid, the section of pipe extending downwardly from the surface of the liquid upon immersion therein;

a second section of pipe to be directed upwardly from the surface of the liquid; and a third section of pipe joining the top of said first section and the bottom of said second section of pipe, the interconnection of said third section with said first section of pipe being located higher than the interconnection of said third section with said second section of pipe to provide for entrapment of liquid within said third section upon immersion of said first section of pipe into the liquid up to said first-mentioned interconnection; and wherein said first section includes a liquid inlet at a bottom end thereof and an air port at the top end thereof, there being a liquid discharge port at the the top end of said second section of pipe; said device further including pressure means for appying a pressure differential between said air port and said discharge port, said pressure differential means being responsive to the presence of liquid in said third section of pipe such that pressure from said pressure differential means builds up when said third section is closed off with liquid and decreases upon the voiding of said third section and said second section of liquid; and wherein said air port forms a tee with said interconnection of said third section with said first section of pipe to set said pressure means away from a path of liquid flow between said first and said third sections of pipe, thereby to form a bead of liquid in said third section in response to said pressure differential, and to provide an air passage to said pressure means via said air port upon discharge of said bead of liquid at said discharge port, said pressure differential and said air passage being formed alternately and repetitively during the presence of solar and/or wind energy.

2. A device according to claim 1 wherein said pressure differential means comprises a container of air coupled to said vent, said container being coated with a material for absorbing rays of solar energy to provide for a heating of air within said container upon exposure of said container to the rays of the sun.

3. A device according to claim 1 wherein said pressure differential means comprises an airfoil configured as a venturi and positioned adjacent said discharge port to provide for a reduction in air pressure thereat upon a blowing of wind through said airfoil.

4. A device according to claim 1 wherein said inlet includes a constriction to slow the rate of entry of liquid into said first section of pipe so as to permit air pressure to be equalized between said air port and said inlet during an interval of time between the discharge of a bead of liquid from said discharge port and a refilling of said third section of pipe.

5. A device according to claim 2 wherein said inlet includes a constriction to slow the rate of entry of liquid into said first section of pipe so as to permit air pressure to be equalized between said air port and said inlet during an interval of time between the discharge of a bead of liquid from said discharge port and a refilling of said third section of pipe.

6. A device according to claim 3 wherein said inlet includes a constriction to slow the rate of entry of liquid into said first section of pipe so as to permit air pressure to be equalized between said air port and said inlet during an interval of time between the discharge of a bead of liquid from said discharge port and a refilling of said third section of pipe.

7. A device for the raising of liquid by the use of solar and/or wind energy comprising:

a first section of pipe to be immersed in the liquid, the section of pipe extending downwardly from the surface of the liquid upon immersion therein;

a second section of pipe to be directed upwardly from the surface of the liquid; and a third section of the pipe joining the top of said first section and the bottom of said second section of pipe, the interconnection of said third section with said first section of pipe being located higher than the interconnection of said third section with said second section of pipe to provide for entrapment of liquid within said third section upon immersion of said first section of pipe into the liquid up to said first mentioned interconnection; and wherein said first section includes a liquid inlet at a bottom end thereof and an air port at the top end thereof, there being a liquid discharge port at the top end of said second section of pipe; said device further including pressure means for applying a pressure differential between said air port and said discharge port, said pressure differential means being responsive to the presence of liquid in said third section of pipe such that pressure from said pressure differential means builds up when said third section is closed off with liquid and decreases upon the voiding of said third section and said second section of the liquid;

said pressure differential means comprises a container of air coupled to said vent, said container being coated with a material for absorbing rays of solar energy to provide for a heating of air within said container upon exposure of said container to the rays of the sun; and said pressure differential means further comprises means for receiving wind, and means coupled between said wind-receiving means and said container for positioning the liquid between said wind-receiving means and said container; said liquid positioning means acting as a valve for conducting and terminating a flow of air between said wind-receiving means and said container.

8. A device for the raising of liquid by the use of solar and/or wind energy comprising:

a first section of pipe to be immersed in the liquid, the section of pipe extending downwardly from the surface of the liquid upon immersion therein;

a second section of pipe to be directed upwardly from the surface of the liquid; and a third section of the pipe joining the top of said first section and the bottom of said second section of pipe, the interconnection of said third section with said first section of pipe being located higher than the interconnection of said third section with said second section of pipe to provide for entrapment of liquid within said third section upon immersion of said first section of pipe into the liquid up to said first mentioned interconnection; and wherein said first section includes a liquid inlet at a bottom end thereof and an air port at the top end thereof, there being a liquid discharge port at the top end of said second section of pipe; said device further including pressure means for applying a pressure differential between said air port and said discharge port, said pressure differential means being responsive to the presence of liquid in said third section of pipe such that pressure from said pressure differential means builds up when said third section is closed off with liquid and decreases upon the voiding of said third section and said second section of the liquid;

said pressure differential means comprises a container of air coupled to said vent, said container being coated with a material for absorbing rays of solar energy to provide for a heating of air within said container upon exposure of said container to the rays of the sun; and said pressure differential means further comprises means for receiving wind, and a valve assembly coupled between said wind receiving means and said container, said valve assembly including a valve member operative in response to pressure of said wind for conducting and terminating a flow of air between said wind-receiving means and said container.

* * * * *